United States Patent [19]

Friese et al.

[11] Patent Number: 4,755,187

[45] Date of Patent: Jul. 5, 1988

[54] METHOD FOR PRODUCING WATERPROOF LEATHER

[75] Inventors: Hans-Herbert Friese, Monheim; Uwe Ploog, Haan; Wolfgang Prinz, Monheim, all of Fed. Rep. of Germany

[73] Assignee: Henkel Kommanditgesellschaft auf Aktien, Duesseldorf, Fed. Rep. of Germany

[21] Appl. No.: 835,499

[22] Filed: Mar. 3, 1986

[30] Foreign Application Priority Data

Mar. 1, 1985 [DE] Fed. Rep. of Germany ..... 3507241

[51] Int. Cl.[4] ..... C14C 5/00; C14C 11/00

[52] U.S. Cl. ..... 8/94.23; 8/94.1 R; 8/94.21; 8/94.22

[58] Field of Search ..... 8/94.22, 94.21, 94.1 R, 8/94.23

[56] References Cited

U.S. PATENT DOCUMENTS

| | | | |
|---|---|---|---|
| 2,693,996 | 11/1954 | Von Fuchs | 8/94.22 |
| 3,291,557 | 12/1966 | Neher et al. | 8/94.22 |
| 3,668,124 | 6/1972 | Cassella, Jr. | 8/94.22 |

FOREIGN PATENT DOCUMENTS

| | | |
|---|---|---|
| 1669347 | 5/1971 | Fed. Rep. of Germany . |
| 3419405 | 11/1985 | Fed. Rep. of Germany . |
| 1559985 | 5/1969 | France . |

OTHER PUBLICATIONS

"Das Leder", vol. 33, (1982), Mar., No. 3, Germany

European Search Report.

*Primary Examiner*—Paul Lieberman
*Assistant Examiner*—John F. McNally
*Attorney, Agent, or Firm*—Ernest G. Szoke; Henry E. Millson, Jr.; Mark A. Greenfield

[57] ABSTRACT

A process for leather tanning having the improvement of imparting waterproof properties to the leather by incorporating a sulfosuccinic monoester in the fatliquor.

29 Claims, No Drawings

METHOD FOR PRODUCING WATERPROOF LEATHER

BACKGROUND OF THE INVENTION

1. Field of the Invention

The invention relates to waterproofing leather by incorporating particular fatliquoring agents which import hydrophobic properties. The particular agents include sulfosuccinic acid monoester salts.

2. Statement of Related Art

Waterproof leather is produced by three basic methods, namely:

(1) impregnation by incorporation of water-insoluble substances, for example solid fats, waxes or particular polymers;

(2) impregnation by incorporation of water-swelling substances which, on taking up water, form highly viscous emulsions and block the fiber interstices of the leather, for example special emulsifiers of the water-in-oil (W/O) type; and (3) treatment with hydrophobicizing substances, for example aluminium and chromium complexes, silicones or organic fluorine compounds.

These methods may be applied in the course of conventional fatliquoring using conventional fatliquoring agents, the impregnating and treatment agents mentioned being introduced into the fatliquoring bath.

A combination of methods (2) and (3) is often applied in practice, the drum or tumbler preferably being filled with aqueous liquor for economic and ecological reasons. The W/O emulsifiers are converted into hydrophobicizing metal salt complexes by fixing with chromium or aluminium salts. However, there are disadvantages to this process because, due to the instability of the fatliquoring emulsions normally used, impregnation has to be carried out at relatively high pH vaues (>6) in order to avoid precipitation of the fatliquoring agents on the surface with resultant smearing. In addition, the fatliquoring bath generally has to have a high temperature of around 60° C. in this process which loosens the grain of the leather. Furthermore, penetrometer values obtained in practice frequently show considerable variations due to an uneven distribution of fat through the leather, so that the leather may have to be expensively aftertreated by spraying, casting or plush coating.

The fatliquoring bath is not stabilized with anionic and nonionic emulsifiers, such as alkylsulfates, alkylarylsulfonates or fatty alcohol ethoxylates, because of the increase in permeability to water vapor.

As used throughout this specification, the term "leather" is meant to include skins, hides, and similar materials of animal origin to which hydrophobic properties are to be imparted.

Other than in the operating examples, or where otherwise indicated, all numbers expressing quantities of ingredients, reaction conditions, or defining ingredient parameters used herein are to be understood as modified in all instances by the term "about".

Published German patent application No. 16 69 347 describes the use of sulfosuccinic acid esters emulsifiable in water for the fatliquoring of leather. In this case, however, no waterproofing effect is obtained.

Published German patent application No. 34 19 405 relates to a process for the production of leather in which a combination of sulfosuccinic acid esters with certain anionic or nonionic emulsifiers is used as fatliquoring agent in the tranning liquor during chrome or aluminum tanning or retanning. Once again, no waterproofing effect is obtained.

DESCRIPTION OF THE INVENTION

It has now been found that leathers fatliquored with a composition containing known fatliquoring agents as well as at least one $C_{12-24}$, preferably $C_{16-24}$, or alternatively $C_{16-22}$ or $C_{16-18}$, aliphatic sulfosuccinic acid monoester or its salt combines extreme softness with reduced permeability to water provided that, after acidification, the fatliquoring agent is fixed with chromium and/or aluminum salts.

In this way, it is possible, using sulfosuccinic acid monoesters in the impregnating and/or hydrophobicizing fatliquoring treatment, to improve the stability of the fatliquoring emulsions to such an extend that the previously described disadvantages of conventional processes do not arise.

Accordingly, the present invention relates to a process for the production of waterproof leathers using sulfosuccinic acid monoesters in combination with impregnating and/or hydrophobicizing fatliquoring compositions. In particular, after retanning, the leathers are treated in an aqueous bath with at least one impregnating and/or hydrophobicizing fatliquoring composition containing at least one sulfosuccinic acid monoester salt having a $C_{12-24}$ fatty residue and, after acidification, the fatliquoring composition is fixed by addition of a chromium and/or aluminum salt.

The at least one sulfosuccinic acid monoester salt is preferably used in combination with impregnating fatliquoring agents, including in particular: oxidized or oxidized and partly sulfonated $C_{18-26}$ hydrocarbons or $C_{32-40}$ waxes; phosphoric acid mono-$C_{12-24}$-alkyl esters; partial esters of polycarboxylic acids, such as citric acid mono-$C_{16-24}$-alkyl esters; partial esters of polyalcohols, such as sorbitan-, glycerin- or pentaerythritol-$C_{16-24}$-fatty acid esters; or any mixture thereof.

The at least one sulfosuccinic acid monoester salt makes up from 10 to 60%, preferably from 20 to 40%, by weight of the fatliquoring composition. Depending on the type of leather, the fatliquoring composition itself is used in a quantity of from 5 to 20% by weight, based on the pared weight of the leather.

The sulfosuccinic acid monoesters also may be used in combination with known fatliquoring ingredients including neutral oils, such as long chain hydrocarbons, chloroparaffin, animal and vegetable oils and fats or methylesters thereof and chlorinated fatty acid methylesters, in which instance the permeability of the leather to water is also reduced if, after fatliquoring, the fatliquoring solution is acidified and fixed with chromium and/aor aluminum salts.

The above monoesters may also be used for normal fatliquoring in conjunction with sulfated, sulfited and/or synthetic fatliquoring agents based on chloroparaffin sulfonates, more or less pronounced impermeability to water being obtained according to the percentage of impregnating and/or hydrophobicizing fatliquoring agent in the combination.

The sulfosuccinic acid monoester salts are produced in known manner by esterification of maleic acid anhydride with approximately one equivalent of the desired esterification component, followed by reaction with a sulfite or bisulfite in a quantity substantially equivalent to the maleic acid anhydride, such as in accordance with previously discussed published German patent application No. 16 69 347. Suitable esterification components are $C_{12-24}$ aliphatios (fatty residues) and compounds containing hydroxyl groups. The aliphatics may be saturated or unsaturated and may be derived from: fatty alcohols or fatty acid mono- or diglycerides, for example $C_{12-18}$ coconut oil fatty alcohol, $C_{12-18}$ tallow alcohol, $C_{16-18}$ tallow fatty acid monoglyceride; or from adducts of from 1 to 6 mols of alkylene oxide with the abovementioned fatty alcohols or fatty acid glycerides or with fatty acids, for example the adduct of from 2 to 3 mols of ethylene oxide with a $C_{16-18}$ tallow fatty alcohol or the adduct of from 4 to 6 mols of ethylene oxide with a $C_{16-24}$ fatty acid mixture of the adduct of 2 mols of ethylene oxide with a $C_{12-18}$ fatty acid mixture. The sulfosuccinic acid monoester salts are preferably prepared as sodium or ammonium salts, although other alkalis such as potassium or organic amines may be used as cations.

The sulfosuccinic acid monoester salts are fixed by water soluble chromium and/or aluminum salts. It is preferred to use basic chromium or aluminum salts or mixtures thereof, of the type also used for tanning leather. The water-soluble chromium and/or aluminum salts are used in the fatliquoring bath in a quantity effective to fix the monoesters, preferably from 1 to 10% by weight.

The claimed process is carried out by applying the sulfosuccinic acid monoester salts and, optionally, other fatliquoring agents as the fatliquor after retanning and, optionally, dyeing and after the subsequent removal of excess tanning agent by washing. High temperatures above 50° C. could be avoided. The aftertreatment is initially carried in the usual way by acidification, using any leather compatible acid in an acidifying effective amount, such as sulfuric, preferably formic acid, optionally preceded by a brief treatment with a polyacrylate tanning agent. This is followed by fixing with the chromium and/or aluminium salts at around pH 3.5.

The inventive fatliquoring agents are effectively taken up by the leather and are uniformly distributed throughout its entire cross-section. They show remarkable resistance to water and provide the leather with outstanding impermeability to water, particularly under dynamic stressing.

The leathers obtained are soft and first grained with a pleasant lardy feel and are particularly suitable for the production of shoe upper leather, garment quality suede and heavy suede.

EXAMPLE 1

Hide upper:

Wet-blue hides chrome tanned in the usual way, but without any addition of anionic surfactants (pH 3.8, pared thickness 1.8 mm), are further processed as follows:

| Procedure | Amount (%) | Ingredient | Time (min.) |
|---|---|---|---|
| Washing | 200 | water 40° C.<br>drain off liquor | 20 |
| Neutralization: | 200<br>and 1.5 | water 45° C.<br>neutral auxiliary tanning agent based on a phenol/napthalene condensate, pH leather cross-section 4.8 | 30 |
| Dyeing: | 1 | acid dye | 20 |
| Retanning: | 3 | synthetic tanning agent based on a phenol condensate | 30 |
| | and 3 | vegetable tanning agent | |
| | 0.5 | formic acid<br>pH ~ 3.8<br>drain off liquor | 30 |
| Washing: | 300 | water 45° C.<br>drain off liquor | 15 |
| Fatliquoring: (INVENTIVE AGENTS) | 200<br>and<br>(A) 6 | water 50° C.<br>AS $C_{16-18}$ sulfosuccinic acid monoester, Na salt | 45 |
| | (B) 4 | AS $C_{16-18}$ sulfosuccinic acid monoester, Na salt | 45 |
| | and 2 | $C_{16-18}$ fatty acid methyl ester, chlorinated | |
| | (C) 2.5 | AS sulfosuccinic acid monoester (alcohol component: $C_{16-22}$ fatty acid-1 P.O.-adduct), $NH_4$ salt | 45 |
| | and 2.5 | AS phosphoric acid mono-$C_{12-18}$-alkylester, $NH_4$ salt | |
| | and 1.5 | AS $C_{16-18}$ fatty acid triglyceride | |
| | 3 | polyacrylate tanning agent | 30 |
| Acidification: | 0.3 | formic acid | 30 |
| Fixing: | 2 | chrome tanning agent, 33% basic | 30 |
| | 2 | aluminium tanning agent, 25% basic pH about 3.5, then drain off liquor | 30 |

After adequate washing, the leather was blocked and finished as usual. Soft, firm-grained leathers having a pleasant feel were obtained. Penetrometer testing produced the following results (compression 10%):

| | A | B | C |
|---|---|---|---|
| Water penetration after | 25 mins. | 90 mins. | >480 mins. |
| Water uptake after 1 hour | ca. 70% | ca. 34% | — |
| Water uptake after 6 hours | — | — | <20% |

EXAMPLE 2

Hide upper, waterproof:

Starting material: wet-blue hides chrome-tanned in the usual way, but without surfactants; pared thickness 2.2 mm.

| Procedure | Amount (%) | Ingredient | Time (min.) |
|---|---|---|---|
| Washing | 300 | water 45° C.<br>drain off liquor | 15 |
| Neutralization: | 200<br>and 2 | water 40° C.<br>neutral auxiliary tanning agent based on a phenol/napthalene condensate | 60 |
| Retanning: | 21 | vegetable tanning agent | 12 (hours) |
| | 2 | aluminium tanning agent, 25% basic | 30 |
| | then | drain off liquor<br>wash<br>pH 4.2 in the leather | |

-continued

| Procedure | Amount (%) | Ingredient | Time (min.) |
|---|---|---|---|
| Dyeing: | 200 | water 55° C. | 20 |
| | and 1 | anionic dye | |
| Fatliquoring: (INVENTIVE AGENTS) | 4 | AS sulfoxidized slack paraffin wax | 45 |
| | and 2 | AS phosphoric acid mono-$C_{16-18}$ alkyl ester | |
| | and 1 | AS sulfosuccinic acid mono-$C_{16-24}$-alkyl ester, Na salt | 45 |
| | 3 | polyacrylate tanning agent | 30 |
| Acidification: | 1 | formic acid drain off liquor | 30 |
| Fixing: | 200 | water 40° C. | 30 |
| | and 2 | chrome tanning agent 33% basic | |
| | 2 | aluminium tanning agent, 25% basic pH about 3.5, then drain off liquor, wash | 30 |

Leather to block and finish as usual.

Soft, firm-grain leathers thoroughly fatliquored throughout were obtained. Penetrometer testing produced the following results (compression 7.5%):

Water penetration after >480 minutes

Water uptake after 6 hours <20%

EXAMPLE 3

Soft hide upper, fashion-quality:

Starting material: wet-blue hides chrome tanned in the usual way, but without surfactants, pared thickness 2.0 mm.

| Procedure | Amount (%) | Ingredient | Time (min.) |
|---|---|---|---|
| Washing | 300 | water 40° C. drain off liquor | 15 |
| Neutralization: | 150 | water 40° C. | 20 |
| | and 1 | Na formate | |
| | 1.5 | auxiliary tanning agent based on a phenol/napthalene condensate | 20 |
| Dyeing: | 1 | anionic dye | 15 |
| Retanning: | 3 | phenol condensate | 30 |
| | and 3 | mimosa | |
| | 0.5 | formic acid drain off liquor, wash | 30 |
| Fatliquoring: (INVENTIVE AGENTS) | 100 | water at 50° C. | 45 |
| | and 1.5 | AS sulfated neat's foot oil | |
| | and 0.5 | AS glycerin mono-$C_{16-18}$ alkylester | |
| | and 2 | AS sulfosuccinic acid mono-$C_{16-18}$-alkylester, $NH_4$ salt | |
| | and 2 | AS phosphoric acid mono-$C_{16-18}$-alkyl-ester | |
| | 3 | polyacrylate tanning agent | 30 |
| Acidification: | 0.5 | formic acid pH about 3.7, then drain off liquor | 30 |
| Fixing: | 200 | water 40° C. | |
| | and 2 | chrome tanning agent, 33% basic | 30 |
| | 2 | aluminium tanning agent, 25% basic, drain off liquor, then wash | 30 |

Soft, firm-grained leathers having a pleasant feel were obtained after finishing in the usual way. Penetrometer testing produced the following results (compression 15%):

Water penetration after ca. 90 minutes

Water uptake after 1 hour ca. 35%

EXAMPLE 4

Suede, garment-quality

Starting material: sheepskins tanned in the usual way, pared thickness 0.7 mm.

| Procedure | Amount (%) | Ingredient | Time (min.) |
|---|---|---|---|
| Washing: | 300 | water 40° C. drain off liquor | 20 |
| Neutralization: | 200 | water 45° C. | 20 |
| | and 1 | auxiliary tanning agent based on a phenolnapthalene condensate pH about 4.5 leather cross-section | |
| Retanning: | 3 | resin tanning agent | 40 |
| Fatliquoring: (INVENTIVE AGENTS) | 5 | AS sulfated neat's foot oil | 40 |
| | and 2 | neat's foot oil | |
| | and 3 | AS mixture of: sulfosuccinic acid mono $C_{16-18}$-alkyl ester, Na salt, and phosphoric acid mono-$C_{12-18}$-alkylester, $NH_4$ salt ratio of 3:2 | |
| | 0.8 | formic acid drain off liquor, cold rinse, leather to block, slick, hang-dry, stake, buff. | 30 |
| Dyeing | (% based on dry weight) | | 45 |
| | 1000 | water 45° C. | |
| | and 5 | ammonia solution, 25% | |
| | and 5 | anionic dye pH~8 | |
| | 5 | formic acid pH~4 | 30 |
| | 2 | cationic resin tanning agent | 20 |
| | 2 | anionic dye | 30 |
| Acidification: | 2 | formic acid pH~3.8 | 30 |
| Fatliquoring: (INVENTIVE AGENTS) | 10 | AS mixture of sulfosuccinic acid mono-$C_{16-18}$-alkyl-ester, Na salt phosphoric acid mono-$C_{12-18}$-alkyl-ester, $NH_4$ salt, ratio of 3:2 | 40 |
| Fixing: | 3 | aluminium tanning agent, 25% basic pH about 3.5, then drain off liquor rinse at 25° C., and finish. | 30 |

The leathers were soft and smooth with a good dye finish and showed a pronounced water-repellent effect.

EXAMPLE 5

Heavy suede

Starting material: air-dried sheepskins

The sheepskins were processed to the color of hair in the usual way by soaking, washing, pickling/tanning, retanning and fatliquoring. Impregnation was then carried out as follows in the suede dye:

| Procedure | Amount g/l | Ingredient | Time (min.) |
|---|---|---|---|
| Suede dyeing: | | liquor ratio 1:20 water 40° C. | 90 |
| | and 2 | $NH_3$ | |
| | and 1 | dye | |
| | and 1 | auxiliary tanning agent | |
| | and 2 | chloroparaffin sulfonate | |
| | and 1 | dyeing auxiliary | |
| Fatliquoring: (INVENTIVE AGENTS) | 11 | a mixture of: sulfosuccinic acid mono-$C_{16-18}$-fatty acid-1 P.O.-ester, $NH_4$/Na salt; phosphoric acid mono-$C_{12-18}$-alkyl ester, $NH_4$ salt; and neat's foot oil; weight ratio. 2:2:1 | 45 |
| Acidification: | 1.5 | formic acid added in 4 portions drain off liquor, rinse | 30 |
| Fixing: | | water 30° C. | 10 |
| | 0.5 | formic acid | |
| | 5 | aluminium tanning agent, 25% basic | 60 |

To block without rinsing, hang-dry.

Soft, fleecy suedes having a pronounced water repellent effect are obtained.

We claim:

1. In a process for the tanning of leather, comprising at least the steps of dyeing and/or tanning, retanning, and fatliquoring, the improvement of imparting waterproof properties to said leather by:

(a) treating said leather, after retanning, with an aqueous fatliquoring composition consisting essentially of a water-proofing effective amount of at least one salt of a $C_{12-24}$ aliphatic sulfosuccinic acid monoester or its salt;

(b) acidifying the treated leather by contacting it with an acidifying effective amount of at least one leather-compatible acid; and then, (c) fixing the treated and acidified leather by contacting it with a fixing-effective amount of at least one water-soluble chromium salt, or aluminum salt, or a mixture thereof.

2. The proccess of claim 1 wherein said monoester is a $C_{16-24}$-fatty acid residue, Na and/or $NH_4$ salt.

3. The process of claim 1 wherein said monoester is $C_{16-22}$-fatty acid residue, Na and/or $NH_4$ salt.

4. The process of claim 1 wherein said monoester is a $C_{16-18}$-fatty acid residue, Na and/or $NH_4$ salt.

5. The process of claim 1 wherein said leather-compatible acid is formic acid.

6. The process of claim 1 wherein said fixing is with a basic salt.

7. The process of claim 1 wherein said fatliquor composition also contains at least one: $C_{18-26}$ hydrocarbon or $C_{32-40}$ wax which has been oxidized or oxidized and partly sulfonated; phosphoric acid mono-$C_{12-24}$-alkyl ester; partial ester of a polycarboxylic acid; partial ester of a polyalcohol; or any mixture thereof.

8. The process of claim 7 wherein said partial ester of a polycarboxylic acid is a citric acid mono-$C_{16-24}$-alkyl ester, and said partial ester of a polyalcohol is a sorbitan-, glycerin-, or pentaerythritol-$C_{16-24}$-fatty acid ester.

9. The process of claim 1 wherein said sulfosuccinic acid monoester or its salt comprises about 10 to 60% by weight of said fatliquoring composition.

10. The process of claim 1 wherein said sulfosuccinic acid monoester or its salt comprises about 20 to 40% by weight of said fatliquoring composition.

11. The process of claim 1 wherein said entire fatliquoring composition is used in a quantity of about 5 to 20% by weight, based upon the pared weight of the leather.

12. The process of claim 1 wherein the salt of (c) is present in about 1 to 10% by weight, based upon the weight of tanning liquor.

13. The process of claim 1 wherein said (b) acidifying, and (c) fixing are effected by adding the indicated ingredients cumulatively to the fatliquor of (a).

14. The process of claim 1 wherein the fatliquor of (a) contains at least one neutral oil, chloroparaffin, animal oil or fat, animal oil or fat methyl ester, vegetable oil or fat, vegetable oil or fat methyl ester, chlorinated fatty acid methyl ester, or any combination thereof.

15. The process of claim 7 wherein the fatliquor of (a) contains at least one neutral oil, chloroparaffin, animal oil or fat, animal oil or fat methyl ester, vegetable oil or fat, vegetable oil or fat methyl ester, chlorinated fatty acid methyl ester, or any combination thereof.

16. The process of claim 1 wherein the fatliquor of (a) contains at least one sulfated fatliquoring agent, sulfited fatliquoring agent, chloroparaffin sulfonate fatliquoring agent, or any combination thereof.

17. The process of claim 7 wherein the fatliquor of (a) contains at least one sulfated fatliquoring agent, sulfited fatliquoring agent, chloroparaffin sulfonate fatliquoring agent, or any combination thereof.

18. The process of claim 14 wherein the fatliquor of (a) contains at least one sulfated fatliquoring agent, sulfited fatliquoring agent, chloroparaffin sulfonate fatliquoring agent, or any combination thereof.

19. The process of claim 15 wherein the fatliquor of (a) contains at least one sulfated fatliquoring agent, sulfited fatliquoring agent, chloroparaffin sulfonate fatliquoring agent, or any combination thereof.

20. The process of claim 1 wherein the aliphatic component of said sulfosuccinic acid monoester is saturated or unsaturated, and is derived from at least one: fatty alcohol; fatty acid mono- or di-glyceride; adduct of a fatty alcohol with 1 to 6 mols of alkylene oxide; adduct of a fatty acid mono- or di-glyceride with 1 to 6 mols of alkylene oxide; adduct of a fatty acid with 1 to 6 mols of alkylene oxide; or any combination thereof.

21. The process of claim 7 wherein the aliphatic component of said sulfosuccinic acid monoester is saturated or unsaturated, and is derived from at least one: fatty alcohol; fatty acid mono- or di-glyceride; adduct of a fatty alcohol with 1 to 6 mols of alkylene oxide; adduct of a fatty acid mono- or di-glyceride with 1 to 6 mols of alkylene oxide; adduct of a fatty acid with 1 to 6 mols of alkylene oxide; or any combination thereof.

22. The process of claim 14 wherein the aliphatic component of said sulfosuccinic acid monoester is saturated or unsaturated, and is derived from at least one:

fatty alcohol; fatty acid mono- or di-glyceride; adduct of a fatty alcohol with 1 to 6 mols of alkylene oxide; adduct of a fatty acid mono- or di-glyceride with 1 to 6 mols of alkylene oxide; adduct of a fatty acid with 1 to 6 mols of alkylene oxide; or any combination thereof.

23. The process of claim 15 wherein the aliphatic component of said sulfosuccinic acid monoester is saturated or unsaturated, and is derived from at least one: fatty alcohol; fatty acid mono- or di-glyceride; adduct of a fatty alcohol with 1 to 6 mols of alkylene oxide; adduct of a fatty acid mono- or di-glyceride with 1 to 6 mols of alkylene oxide; adduct of a fatty acid with 1 to 6 mols of alkylene oxide; or any combination thereof.

24. The process for the tanning of leather, comprising at least the steps of dyeing and/or tanning, retanning, and fatliquoring, the improvement of imparting waterproof properties to said leather by (a) treating said leather, after retanning, with an aqueous fatliquor composition containing a waterproofing effective amount of at least one waterproofing agent selected from the group consisting essentially of:

$C_{16-18}$-alkyl sulfosuccinic acid monoester, Na salt;

$C_{16-22}$-fatty acid +1 P.O., sulfosuccinic acid monoester, $NH_4$ salt;

$C_{16-24}$-alkyl sulfosuccinic acid monoester, Na salt;

$C_{16-18}$-alkyl sulfosuccinic acid monoester, $NH_4$ salt; and $C_{16-18}$-fatty acid +1 P.O., sulfosuccinic acid monoester, $NH_4$/Na salt.

25. The process of claim 24 wherein said fatliquor composition consists essentially of at least one said sulfosuccinic acid monoester and at least one of:

$C_{16-18}$-fatty acid methyl ester, chlorinated;

$C_{12-18}$-alkyl phosphoric acid monoester, $NH_4$ salt;

$C_{16-18}$-fatty acid triglyceride;

polyacrylate tanning agent;

sulfoxidized slack paraffin wax;

$C_{16-18}$-alkyl phosphoric acid monoester;

sulfated neat's foot oil;

$C_{16-18}$-alkyl glycerin monoester; or neat's foot oil.

26. The process of claim 25 wherein said leather, after fatliquoring, is acidified by adding formic acid.

27. The process of claim 24 wherein after said treatment with an aqueous fatliquor composition, said leather is fixed by contacting it with an aqueous solution of a fixing-effective amount of a chrome salt, an aluminum salt, or their mixture.

28. The process of claim 25 wherein after said treatment with an aqueous fatliquor composition, said leather is fixed by contacting it with an aqueous solution of a fixing-effective amount of a chrome salt, an aluminum salt, or their mixture.

29. The process of claim 26 wherein after said treatment with an aqueous fatliquor composition, said leather is fixed by contacting it with an aqueous solution of a fixing-effective amount of a chrome salt, an aluminum salt, or their mixture.

* * * * *